US008424683B2

(12) United States Patent
Fryer et al.

(10) Patent No.: US 8,424,683 B2
(45) Date of Patent: Apr. 23, 2013

(54) PORTABLE ROLLED WIPING PRODUCT

(75) Inventors: Dennis Edward Fryer, Ashford (GB); Martin Christopher Bunce, Pewsey (GB); William John Maskell, Marlborough (GB); Thomas Robert Walton, Marlborough (GB)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1031 days.

(21) Appl. No.: 12/290,586

(22) Filed: Oct. 31, 2008

(65) Prior Publication Data

US 2010/0107350 A1 May 6, 2010

(51) Int. Cl.
*B65D 85/00* (2006.01)

(52) U.S. Cl.
USPC ..... 206/409; 206/233; 206/812; 206/407; 206/289

(58) Field of Classification Search ..... 206/233, 206/812, 389, 407, 409, 390; 221/63
See application file for complete search history.

(56) References Cited

U.S. PATENT DOCUMENTS

| | | | | |
|---|---|---|---|---|
| 2,684,716 | A * | 7/1954 | Mills et al. | 225/15 |
| 3,527,342 | A * | 9/1970 | Manzo | 206/409 |
| 3,964,606 | A * | 6/1976 | Hogg et al. | 206/395 |
| 4,002,264 | A * | 1/1977 | Marchesani | 221/63 |
| 4,101,026 | A * | 7/1978 | Bonk | 206/205 |
| 5,609,269 | A | 3/1997 | Behnke et al. | |
| 5,824,380 | A * | 10/1998 | Hagen | 428/41.9 |
| 6,360,513 | B1 * | 3/2002 | Strand et al. | 53/412 |
| 6,578,731 | B1 * | 6/2003 | Lewis et al. | 221/46 |
| 6,688,078 | B2 * | 2/2004 | Mauclair et al. | 53/412 |

OTHER PUBLICATIONS

American Society for Testing Materials (ASTM) Designation: D1388-08, "Standard Test Method for Stiffness of Fabrics," pp. 1-6, published Oct. 2008.

* cited by examiner

*Primary Examiner* — J. Gregory Pickett
*Assistant Examiner* — Blaine Neway
(74) *Attorney, Agent, or Firm* — Michael J. Sullivan

(57) ABSTRACT

A portable rolled product containing a small roll of sheets, such as tissues or wet wipes, is particularly useful for uses outside the home. The roll of sheets is contained within a flexible package, such as a plastic film wrapper, having a roll housing portion and an extended dispensing portion or channel through which the user withdraws the product. After the desired amount of the sheets is withdrawn, the extended dispensing channel can be folded back around the roll housing portion of the package for storage until further use.

17 Claims, 4 Drawing Sheets

PORTABLE ROLLED WIPING PRODUCT

BACKGROUND OF THE INVENTION

From time to time, consumers have a need for wiping products, such as tissue or wet wipes, when they are away from home. Existing commercial products, which consist of a small roll of toilet paper within a rigid thermoformed plastic dispenser, generally meet the need for providing a relatively portable source of small amount of toilet paper. To access the roll of toilet paper, the user opens the dispenser to expose the roll, grasps the available leading edge of the roll and removes the desired amount of toilet paper. However, such products require handling or touching of the small roll, which can be unsanitary. Also, the rigid plastic container can be a bit bulky due to its size and rigidity, which is unsuitable for storage in some pockets and also takes up a fair amount of space if placed in one's purse. Therefore there is a need for a portable wiping product which provides a relatively small amount of tissue or wet wipes for a limited number of use occasions and which can be more easily carried in one's pocket or purse.

SUMMARY OF THE INVENTION

It has now been discovered that a portable roll of a wiping material can be conveniently packaged in a specially-designed flexible packaging that eliminates the need to touch the roll during dispensing, which provides a number of advantages. In particular, the product is more sanitary and easier to handle/dispense. In addition, due to the flexibility of the packaging, as the roll is used and becomes smaller in diameter, the flexible packaging collapses around the roll and the resulting amount of space taken up by the product decreases. Also, because the roll of wiping material is inherently somewhat flexible, particularly after a portion of the roll is used up, the flexible packaging allows the roll to flex slightly as needed for the product to store more easily and more comfortably in confined spaces, such as one's pocket or purse, for example. Furthermore, the wrapper provides a very effective way of keeping the tissues clean and dry in wet environments, such as a raincoat pocket, or if dropped in a public restroom, for example. Also, unlike rigid thermoformed products on the market, the flexible wrapper is relatively thin and therefore designed to provide maximum functional convenience utilizing the least amount of material.

Hence in one aspect, the invention resides in a product comprising a roll of a wiping material contained within a flexible wrapper, said wrapper having a roll housing portion and an extended dispensing portion or channel through which sheets of the wiping material are unwound from the roll and withdrawn by a user.

For purposes herein, a "sheet" is a distinct, usable amount of the wiping material that can be easily separated from the roll of material. Individual sheets particularly include bath tissue sheets, paper towel sheets, wet wipe sheets, and the like. Such sheets are typically separated by spaced-apart transverse lines of perforations in a long length of the sheet material. However, rolls of sheets can also be wound with individual sheets partially overlapping each other and being completely unattached to the next available sheet within the roll. Such rolls are disclosed in U.S. Pat. No. 5,609,269 entitled "Rolled Tissue Products Containing Discrete Overlapped Tissue Sheets", issued Mar. 11, 1997 to Behnke et al., which is herein incorporated by reference. For wet wipes, individual sheets are also typically separated by spaced-apart transverse lines of perforation in a length of a non-woven material as is well known in the art. Individual sheets can be any size suitable for the intended purpose. For bath tissue, individual sheets measure about 4 inches by 4 inches, for example. The sheets useful for the product of this invention can be, without limitation, single-ply, two-ply, three-ply or four-ply sheets.

The rolls of sheets can be wound around a core, such as is commonly the case for most bath tissues, or the rolls of sheets can be wound coreless, which is more common for wet wipes. Due to the desirability of minimizing the amount of space occupied by the product, coreless rolls of sheet material are advantageous. However, rolls wound around a core can be used, particularly if the diameter of the core is very small, such as about 0.25 inch or less. Methods and equipment for producing both types of rolls are well known in the tissue and wipes arts.

The number of sheets on a roll, which can be at least in part influenced by the sheet length, can advantageously be from about 20 to about 80, more specifically from about 30 to about 70, and still more specifically from about 40 to about 60. Regardless of the number of sheets and the individual sheet length, the diameter of the rolls of sheet material can be about 2 inches or less, more specifically from about 0.5 to about 2 inches, more specifically from about 1 to about 2 inches, and still more specifically from about 1.5 to about 1.75 inches. While larger roll diameters are also within the scope of the products of this invention, the larger rolls detract from the portability of the product and may begin to be cumbersome. Similarly, while any number of sheets can be used, for a given sheet length, larger numbers of sheets will make the diameter of the roll larger, which again detracts from the portability of the product.

The extended dispensing portion of the flexible wrapper can have a length of about 1 inch or greater, more specifically from about 1 to about 10 inches, more specifically from about 1 to about 6 inches, and still more specifically from about 2 to about 4 inches. A length of about 3 inches is particularly suitable. The length must be sufficient to maintain the leading edge of the wipe material in a readily accessible position for dispensing so that the user does not have to reach into the roll housing portion to manipulate the roll. At the same time, it is advantageous to have a relatively long extended dispensing portion so that the user can fold the dispensing portion back and wrap it around the roll housing portion after each dispensing occasion. For wet wipes in particular, longer extended dispensing portions can wrap around the roll housing portion to a greater extent and thereby improve the ability to re-seal the product to prevent or greatly minimize moisture loss from the roll of wipes during storage of the product.

The flexible wrapper can be made of any flexible sheet or film material that may be useful for packaging applications, such as foil/aluminum composites, paper, coated paper, vacuum metalized films, polyethylene films, polypropylene films, polyethylene terephalate (PET) films, polyvinyl chloride (PVC) films, latex/rubber sheets, fabrics (cotton, polyesters, nylons, etc.), leather, etc. (A quantitative measure of sheet flexibility is described in ASTM Standard Test Method D 1388-08, designed to measure the stiffness of fabrics, which measures the length of a 1-inch wide strip of material needed to cause the material to bend under its own weight to a fixed angle as the length of material is advanced over the edge of a supporting surface. This length is referred to as the length of overhang. Samples are conditioned and tested at 23° C. and 50 percent relative humidity.) For purposes herein, without limitation, flexible sheet materials can have a flexibility, as measured by the length of overhang, of about 20 centimeters or less, more specifically about 15 centimeters or less, more specifically about 10 centimeters or less, more specifically about 5 centimeters or less, and still more specifically from about 1 to about 10 centimeters. As points of reference, typical photocopy paper has a length of overhang of about 17 centimeters, while poly films having a thickness of about 0.002 inch, which are particularly useful for purposes of this invention, have a length of overhang of about 5 centimeters. While total directional flexibility is preferred, the flexible wrapper can be flexible in only one direction, that being perpendicular to the axis of the roll, so that it can be folded back around the roll by the user. Such a wrapper could be made of single-sided corrugated board, for example, where its ability to roll in the same direction as the tissue sheet roll would provide functionality. When the product of this invention contains wet wipes, a poly film or paper coated with a moisture barrier is preferred in order to prevent or minimize moisture loss.

The means for creating the various seals referred to herein can depend upon the flexible wrapper material. For example, while conventional heat sealing is convenient and useful for thermoplastic films, adhesives (such as heat-activated adhesive or double-sided adhesive tapes) may be used, particularly for paper or other sheet materials which do not lend themselves to thermal sealing means. Other means for sealing or fixing the flexible wrapper include staples, RF (frequency) welding, laser welding, stitching/sewing, riveting and the like.

A feature of the product of this invention is the isolation and protection of the roll of wiping material while dispensing the sheets through the extended dispensing portion of the flexible wrapper. The roll is untouched during use because only the next available sheet is exposed to the user within the dispensing channel. At the same time, the flexibility of the wrapper enables the user to indirectly grasp the roll to control its rotation. More specifically, once the product is opened, the user's fingers of one hand are placed into the open end of the extended dispensing portion to grasp the leading edge of the first sheet. The other hand is used to grasp the roll housing portion and control the unwinding of the roll, which otherwise freely rotates within the roll housing portion of the flexible wrapper when the user pulls on the exposed sheet(s). When the desired number of sheets have been unwound and removed from the roll, the roll housing portion is grasped sufficiently tightly to prevent further rotation of the roll so that the user can break a perforation line within the extended dispensing portion. This leaves a "tail" or leading edge of the next available sheet within the extended dispensing portion of the wrapper, which is then available for the next dispensing occasion. The extended dispensing portion of the wrapper can be wrapped around the roll housing portion to create a compact, cylindrically-shaped product for storage, which gradually becomes slightly smaller in diameter as some of the sheet material is removed from the roll. An optional closure means can be provided with the product, such as a piece of resealable adhesive tape, a spot of repositionable adhesive, a clip or a rubber band, that can be repositioned as desired by the user to maintain the product in the wrapped or closed position after each use, which is especially advantageous for wet wipes.

DETAILED DESCRIPTION OF THE DRAWINGS

The invention will be further described in connection with the following drawings. Unless otherwise stated, the use of the same reference numbers in different figures is intended to represent the same features.

Figure 1:
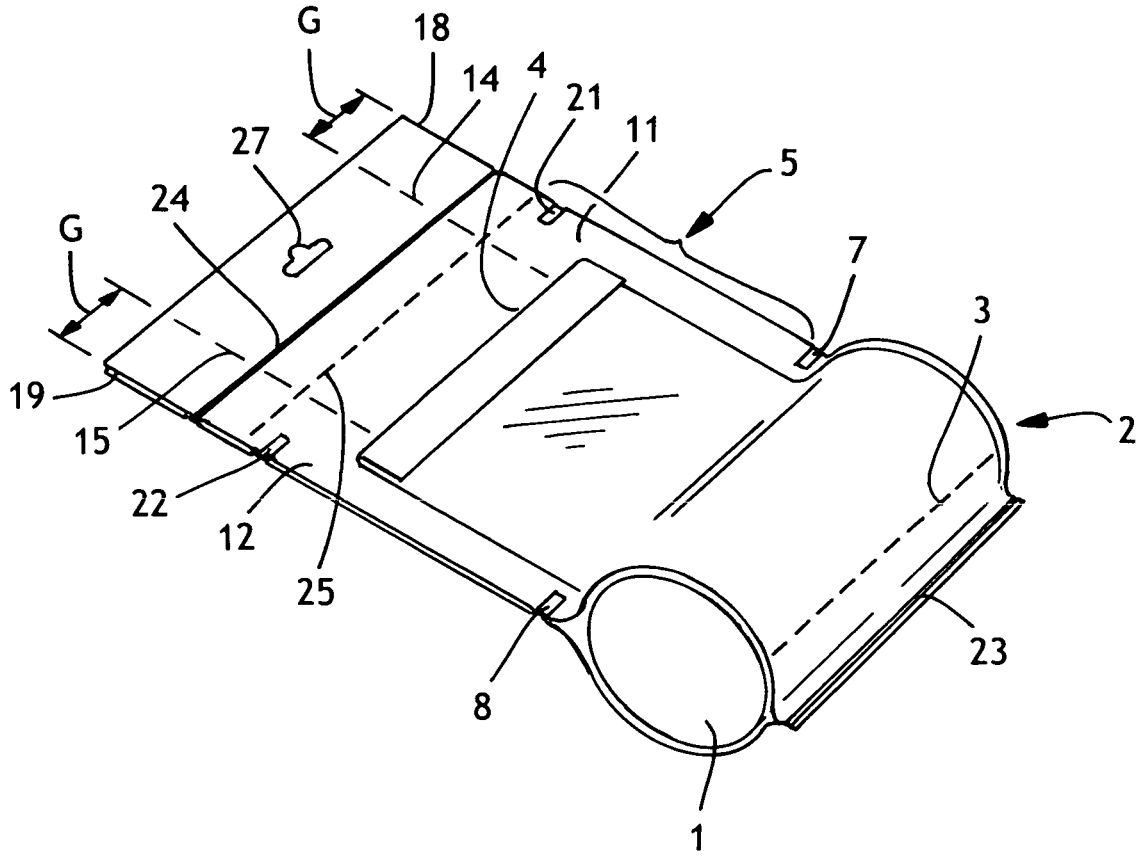
FIG. 1 is a perspective view of a product of this invention.

Referring to FIG. 1, shown is one embodiment of a product of this invention having a coreless roll of bath tissue within a clear thermoplastic film flexible wrapper. While the flexible wrapper as shown is clear for purposes of illustrating the tissue within the product, the flexible wrapper can be opaque, or a combination of clear and opaque (particularly if the flexible wrapper is made from more than one piece of material), and may also contain graphics and/or other printed matter. In particular, shown is the roll of tissue 1 within the roll housing portion 2 of the wrapper. The roll of tissue includes multiple sheets separated by spaced-apart transverse lines of perforations 3. The leading edge 4 of the first available tissue sheet on the roll lies within the extended dispensing portion 5 of the flexible wrapper. In this embodiment, the extended dispensing portion of the flexible wrapper is indicated by the bracket and is measured between the open dispensing end of the product (which is the line of perforations 25 after the line of perforations has been torn open) and the leading edge of the roll housing portion (defined in this embodiment by side seals 7 and 8). In the embodiment shown, the leading edge of the tissue is a folded edge formed by folding the tissue back onto itself. Initially having a folded leading edge present prior to opening the product is a result of the particular manufacturing method used to make the product (described below). While an initial folded leading edge is advantageous, it is not necessary. Instead, all that is needed is that the leading edge of the sheet material be exposed within the extended dispensing portion of the flexible wrapper so that it can be grasped and withdrawn by the user. As mentioned above, a first pair side seals 7 and 8 separate the roll housing portion 2 from the extended dispensing portion 5 and serve to confine the roll of tissue within the roll housing portion. At the same time, the cross-directional distance between the two side seals 7 and 8 is sufficiently great to allow the tissue sheet material to be unwound from the roll of tissue, passing between the side seals, and be dispensed through the extended dispensing portion.

Also shown are two side gussets 11 and 12, which are formed during the manufacturing process as the wrapper is inwardly folded to create fold lines 14 and 15, respectively. While the presence of side gussets is optional, they advantageously provide functionality and a clean look to the final product. As shown, the side gussets are substantially unfolded (expanded) in the roll housing portion of the wrapper to accommodate the presence of the roll. The depth of the gusset folds, as measured from the outer edges 18 and 19 of the extended dispensing portion to the inner fold lines 14 and 15, respectively, is represented by the distance "G". This distance is related to the diameter or radius of the roll of tissue 1. In general, the depth of the gusset folds should be approximately equal to the radius of the roll so that the gusset folds can unfold to make room for the roll. In a specific embodiment as shown, the depth of the gusset folds is about 0.8 inch and the roll diameter is about 1.5 inches. As an alternative, multiple gusset folds in a zig-zag pattern (similar to an accordion) can be used to accomplish the same objective as long as the sum total of the depths of the multiple fold panels is sufficient to unfold and accommodate the roll diameter.

Further regarding the side seals 7 and 8, these seals are created by melting the plastic film to create a thermal bonding site. The side seals penetrate all four of the folded film layers of the side gussets so that the gussets cannot unfold at those points. As mentioned above, the side seals extend inwardly from the edges a distance sufficient to confine the roll of tissue within the roll housing portion of the wrapper. In the specific embodiment referred to above having side gussets, the side seals simply have to seal the gusset folds to prevent them from unfolding. As a result, the side seals do not have to extend inwardly very far from the edge of the product. For embodiments without side gussets, the side seals may have to extend further in from the edges to confine the roll within the roll housing portion. In the embodiment referred to above, the side seals 7 and 8 extend inwardly only about 0.13 inch from the edges. This allows the tissue sheet to pass through the extended dispensing portion of the wrapper without being significantly restricted, if at all. During dispensing, the tissue sheet freely slides through one of the gusset folds (sliding over the gusset fold lines as shown in FIG. 1). An optional second pair of side seals 21 and 22, located near (within about 1 inch) the intended open end of the extended dispensing portion (represented by the line of perforations 25), serve to stabilize the extended dispensing portion to maintain a flat dispensing channel by preventing the gussets from unfolding after the product is opened. The distance between the line of perforations 25 and the side seals 21 and 22 in the embodiment described above is about 0.18 inch. If a refillable flexible wrapper is desired, the side seals 7 and 8 could be made to be semi-permanent such that the user could undo the seals to allow a new roll to be inserted into the roll housing portion. Semi-permanent side seals could be provided by an open/reclose molded clip or by a press stud, for example.

Also shown in FIG. 1 is a first end seal 23, which serves to contain the roll and define the roll housing portion, an optional second end seal 24 in the extended dispensing portion which serves to seal the product prior to use for hygienic purposes and to prevent tampering with the tissue. Inwardly adjacent the second end seal 24 is an optional line of perforations 25 which provides a means for the user to open the product by simply tearing it open along the perforation line. Alternatively, the product can be opened by cutting off the end of the extended dispensing opening, but having the line of perforations is believed to be more convenient for the user. Also shown is an optional hanging opening 27, which is convenient for displaying the product at the point of purchase.

For purposes herein, the portion of the product beyond the opening in the extended dispensing portion (which is created by tearing the line of perforations or otherwise cutting the flexible wrapper), which includes end seal 24 and hanging opening 27, can be referred to as the "discard portion" of the product since it is discarded by the user once the product is opened. The line of perforations 25, the end seal 24 and the hanging opening 27 can be positioned adjacent to each other in the dispensing direction as closely as is practical in order to not waste material. Advantageously, each of these features can be within a range of from about 0.1 to about 0.5 inch of the adjacent feature. For example, in a specific embodiment, the hanging opening is about 0.25 inch from the end seal 24. The distance between the end seal 24 and the line of perforations 25 is about 0.18 inch.

Figure 2:
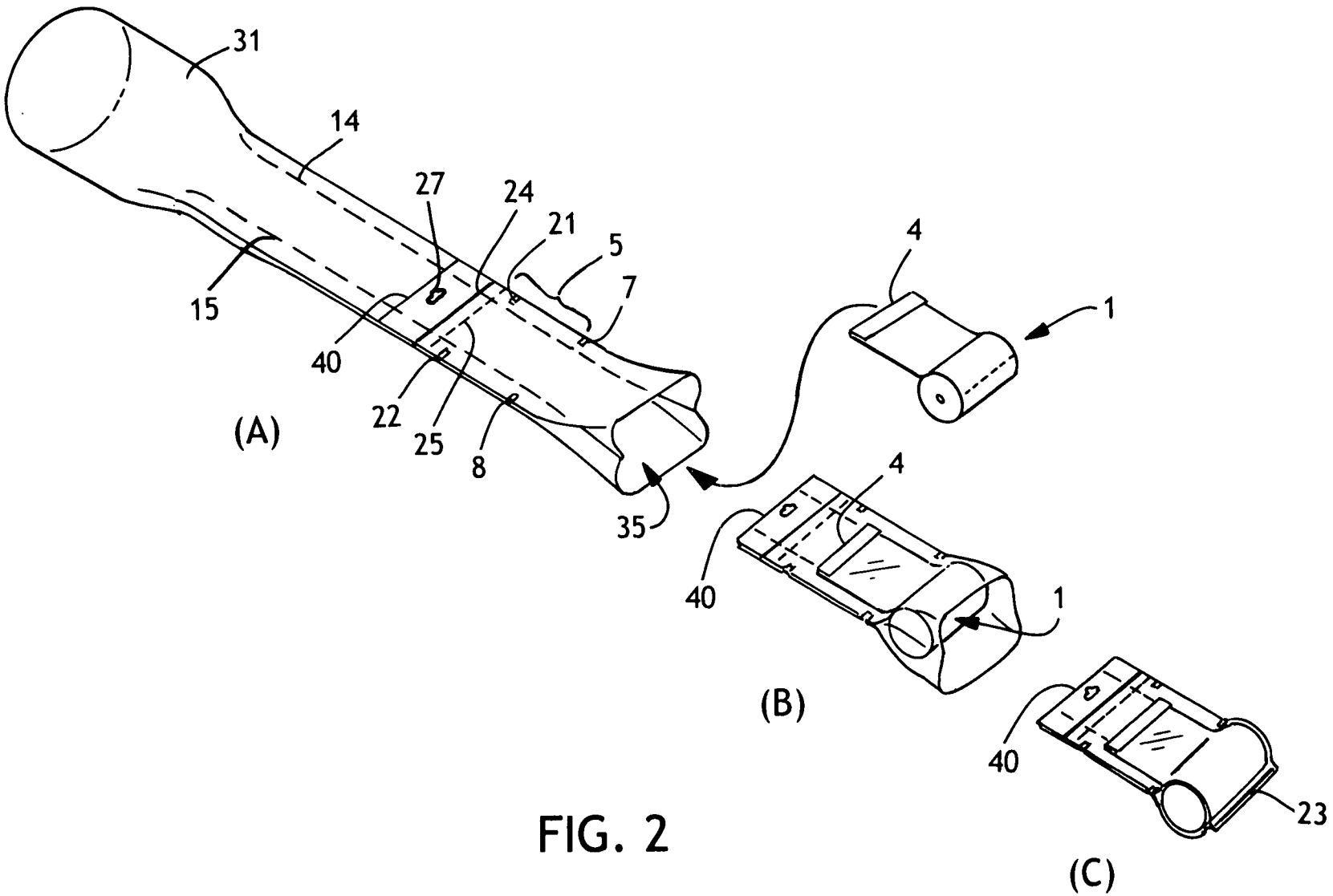
FIG. 2 is a schematic representation of a method of making the product of this invention.

FIG. 2 schematically illustrates a method of making the product of FIG. 1. It will be appreciated by those skilled in the art that other methods can be used to make the product of this invention, including starting with one or more flat films and/or modifying the gusset folding sequence or types of folds or the number of folds. As shown in FIG. 2A, a flexible plastic film sleeve or tube 31 is flattened and inwardly-folded along the side edges to provide the side gussets. The hidden fold lines 14 and 15 represent the gusset folds. (In cross-section the gusset folds would resemble a sideways letter "M" with the apex of the center of the "M" being the fold line. As mentioned below, this fold arrangement provides two potential channels for the sheet to pass through during dispensing.) After the gusset folds are formed, the other features of the product described above can be applied to the resulting gusseted sleeve in any particular order. In particular, side seals 7 and 8, side seals 21 and 22, end seal 24, perforation line 25, hanging opening 27 and cut line 40 can be imparted to the gusseted sleeve. The open end 35 of the gusseted sleeve is provided for insertion of the roll of tissue 1. The distance from the pair of side seals 7 and 8 to the open end 35 should be about half the circumference of the roll of tissue, plus about 10 millimeters in order to provide sufficient room for the roll within the roll housing and to ultimately have sufficient overlap of the ends of the open sleeve for the heat seal 23.

As shown, the leading edge of the tissue sheet 4 and the roll 1 are inserted into the open end 35 of the gusseted sleeve until further insertion of the roll is prevented by the pair of edge seals 7 and 8. In one embodiment, the leading edge of the tissue sheet is folded in order to accept a flat plate, which can be used to urge the folded edge into the narrow opening of the extended dispensing portion 5. Once the folded edge is inserted, the flat plate is withdrawn, leaving the leading edge of the tissue sheet and the roll in the proper position, which is illustrated in FIG. 2B. Thereafter, the roll of tissue is sealed within the wrapper, such as by heat sealing the open edges of the gusseted sleeve to provide end seal 23 (FIG. 2C). The cut line 40 leaves an open end in the gusseted sleeve supply so that the process can be repeated to create another product.

Figure 3:
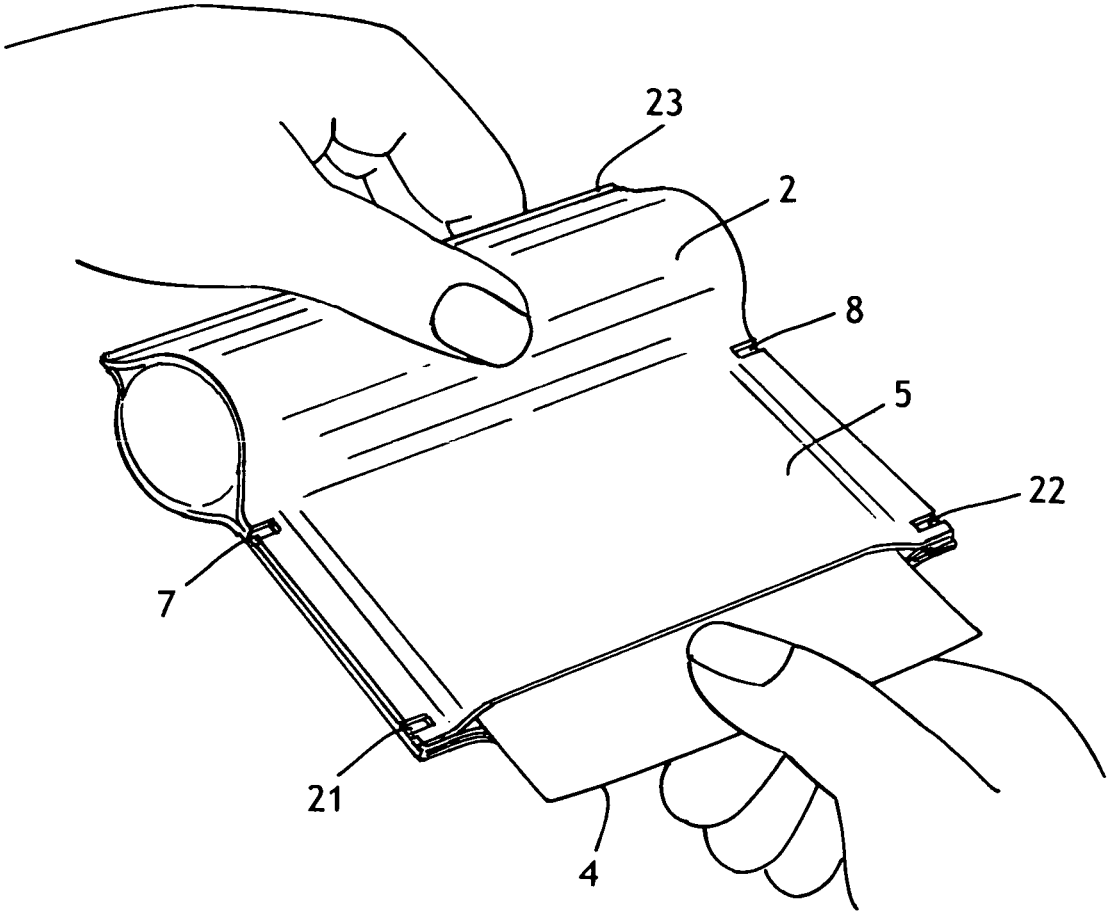
FIG. 3 is a schematic representation of the product of this invention during use, illustrating the user withdrawing a sheet of tissue from the product.

FIG. 3 illustrates the product of this invention during use. As shown, the user can grasp the roll housing portion 2 of the wrapper with the left hand while the leading edge 4 of the tissue sheet is grasped and withdrawn with the right hand. When the desired amount of tissue has been withdrawn, the left hand is used to grasp the roll housing portion sufficiently tightly to prevent the roll within from rotating. Further pulling with the right hand will cause the tissue sheet to tear along a line of perforation within the extended dispensing portion 5. When another amount of tissue is needed, the user can insert the right hand into the open end of the extended dispensing portion and grasp the leading edge of tissue and repeat the process. When finished, the user simply folds the flexible extended dispensing portion back around the roll housing portion for compact storage. As previously mentioned, a closure means, such as adhesive tape, can be used to maintain the product in a closed position.

Figure 4:
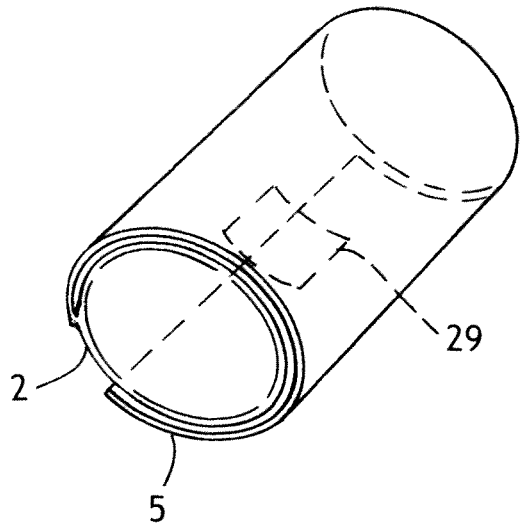
FIG. 4 is a schematic representation of the product of FIG. 1, wherein the dispensing portion of the product is folded back and partially wrapped around the roll and sealed for storage.

FIG. 4 illustrates the embodiment of the invention wherein the extended dispensing portion 5 is folded back and wrapped partially around the roll housing portion 2 and adhered to the roll housing portion with re-sealable adhesive tape 29.

Figure 5:
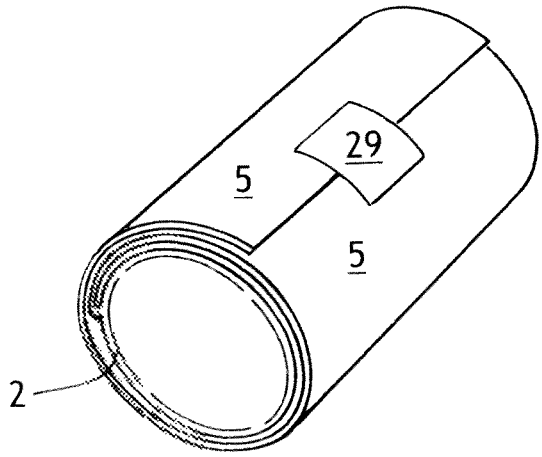
FIG. 5 is a schematic representation of a product of this invention, similar to that of FIG. 4, but wherein the dispensing portion is long enough to wrap completely around the roll.

FIG. 5 illustrates an embodiment similar to that of FIG. 4, but where the extended dispensing portion 5 is sufficiently long to be wrapped completely around the roll housing portion 2 and adhered to itself (the extended dispensing portion) with re-sealable adhesive tape 29.

It will be appreciated that the foregoing description and drawings, given for purposes of illustration, are not to be construed as limiting the scope of this invention, which is defined by the following claims and all equivalents thereto.

We claim:

1. A product comprising a roll of a wiping material contained within a flexible wrapper, said roll having an axis around which the wiping material is wound, said wrapper having a roll housing portion and an extended dispensing portion through which sheets of the wiping material are unwound from the roll and withdrawn by a user in a direction perpendicular to the axis of the roll, wherein the roll freely rotates within the roll housing portion as the sheets of wiping material are unwound from the roll.

2. The product of claim 1 wherein the roll of wiping material is a roll of tissue sheets, each tissue sheet separated from an adjacent tissue sheet by a transverse line of perforations.

3. The product of claim 1 wherein the roll of wiping material is a roll of wet wipes, each wet wipe separated from an adjacent wet wipe by a line of perforations.

4. The product of claim 1 wherein the roll of wiping material is a roll of unattached individual tissue sheets that are wound such that each sheet partially overlaps an adjacent sheet.

5. The product of claim 1 wherein the roll of wiping material is coreless.

6. The product of claim 1 wherein the roll of wiping material contains a core.

7. The product of claim 1 wherein the roll housing portion is separated from the extended dispensing portion by side seals.

8. The product of claim 1 wherein the extended dispensing portion has a length of about 1 inch or greater.

9. The product of claim 1 wherein the extended dispensing portion has a length from about 1 to about 6 inches.

10. The product of claim 1 wherein the extended dispensing portion has a length from about 2 to about 4 inches.

11. The product of claim 1 further comprising a re-sealable adhesive tape, wherein the extended dispensing portion has a length sufficiently long such that it can be folded back and wrapped completely around the roll housing portion and adhered to itself with the adhesive tape to create a cylindrically-shaped product for storage.

12. The product of claim 1 further comprising a re-sealable adhesive tape, wherein the extended dispensing portion can be folded back and wrapped partially around the roll housing portion and adhered to the roll housing portion with the adhesive tape to create a cylindrically-shaped product for storage.

13. The product of claim 1 having gusseted sides.

14. The product of claim 1 having a line of perforations that can be torn to provide an open end in the extended dispensing portion.

15. The product of claim 1 having a line of perforations that can be torn to provide an open end in the extended dispensing portion and having side seals in the extended dispensing portion near the line of perforations.

16. The product of claim 1 having a line of perforations that can be torn to provide an open end in the extended dispensing portion, said product further having a discard portion comprising an end seal.

17. The product of claim 1 having a line of perforations that can be torn to provide an open end in the extended dispensing portion, said product further having a discard portion comprising an end seal and a hanging opening.

* * * * *